United States Patent [19]

Petrie et al.

[11] Patent Number: 4,546,336

[45] Date of Patent: Oct. 8, 1985

[54] RESIDENTIAL CIRCUIT BREAKER WITH COMBINATION SLOT MOTOR AND ARC CHUTE

[75] Inventors: Dennis J. Petrie, Milwaukee; Jerome K. Hastings, Sussex, both of Wis.

[73] Assignee: Eaton Corporation, Cleveland, Ohio

[21] Appl. No.: 528,944

[22] Filed: Sep. 2, 1983

[51] Int. Cl.[4] ..... H01H 77/10

[52] U.S. Cl. ..... 335/16; 335/195; 335/201

[58] Field of Search ..... 335/16, 23, 35, 201, 335/195; 200/147 R, 148 C, 153 G

[56] References Cited

U.S. PATENT DOCUMENTS

| | | | |
|---|---|---|---|
| 2,618,716 | 11/1952 | Boller et al. | 335/6 |
| 3,081,386 | 3/1963 | Koenig et al. | 335/9 |
| 3,185,059 | 6/1974 | Spoelman | 335/16 |
| 3,488,610 | 1/1970 | Powell | 335/23 |
| 4,056,798 | 11/1977 | Malick | 335/16 |
| 4,077,025 | 2/1978 | Slade et al. | 335/16 |
| 4,266,210 | 5/1981 | Mrenna et al. | 335/201 |

FOREIGN PATENT DOCUMENTS

| | | |
|---|---|---|
| 2039881 | 1/1971 | France . |
| 49-44446 | 12/1974 | Japan . |

*Primary Examiner*—John C. Martin
*Assistant Examiner*—George Andrews
*Attorney, Agent, or Firm*—Andrus, Sceales, Starke & Sawall

[57] ABSTRACT

A residential or commercial circuit breaker of the narrow case type, typically having a width of ¾ inch or 1 inch, is provided with a combination slot motor and arc chute 102 mounted within the case 2 and around the current carrying conductors 8 and 12. The combination slot motor and arc chute 102 concentrates the current-induced magnetic repulsive force between the conductors 8 and 12 to boost contact separation force, and also extinguishes the arc. The slot motor portion 106, 108 of the combination structure 102 continues to support the magnetic force which tends to force the arc into the arc chute portion 104 away from the contacts 10, 16 and operating mechanism. The combination slot motor and arc chute 102 is particularly simple and inexpensive, yet very effective within the size constraints of the narrow type breaker case 2.

14 Claims, 9 Drawing Figures

Fig. 2
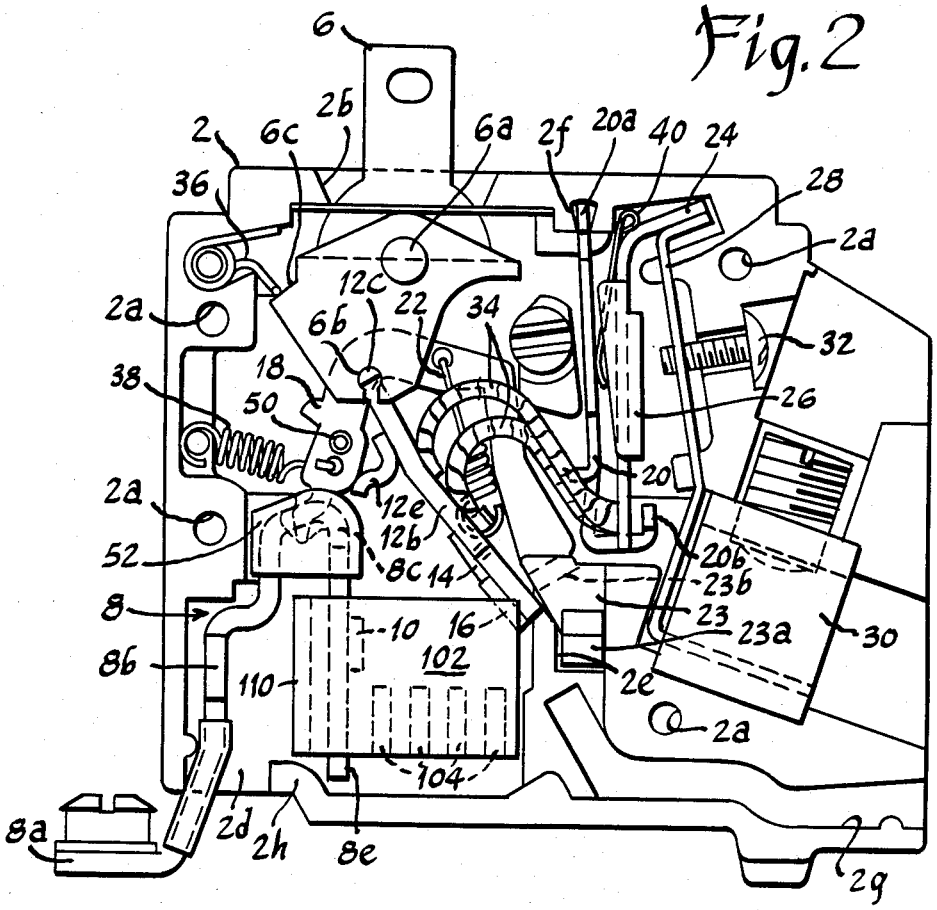
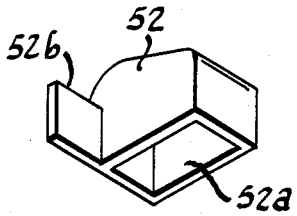
Fig. 9
Fig. 4
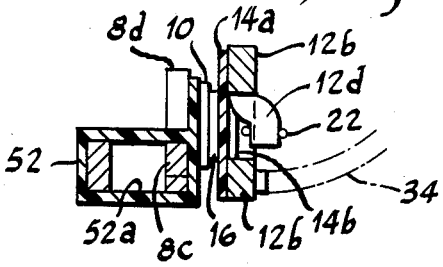

RESIDENTIAL CIRCUIT BREAKER WITH COMBINATION SLOT MOTOR AND ARC CHUTE

BACKGROUND AND SUMMARY OF THE INVENTION

The invention relates to residential branch circuit breakers, which are the molded case, narrow width type, usually 1 inch or ¾ inch, such as shown in U.S. Pat. No. 3,081,386. These breakers are normally utilized in residential and commercial applications up to 240 volts.

Circuit breakers, and the panelboards or load centers to which they are mounted, are designed to be compact and physically compatible with existing apparatus. However, electrical utilities are providing increased available current in new installations. As a result, the short circuit interruption capacity requirement of narrow width circuit breakers has increased from 10,000 amps to 22,000 amps for new breaker designs, while existing apparatus designs place severe limitations on changes in physical arrangement and size.

Together with the high capacity requirement, there is an on-going need to dissipate and extinquish the arc between separating contacts. Furthermore, the arc debris must not be allowed to accummulate or otherwise interfere with the contacts or with operating mechanisms.

These requirements must be met within the narrow width case of residential branch breaker. In contrast, industrial breaker designs do not have such size constraints, and their much higher current interruption capacity involves different design criteria.

The present invention provides a residential breaker incorporating a combination slot motor and arc chute. The combination slot motor and arc chute concentrates the magnetic repulsive force between current carrying conductors to boost contact separation force, and also extinguishes the arc. The slot motor portion of the combination structure continues to support the magnetic force which tends to force the arc into the arc chute portion away from the contacts and operating mechanism.

The combination slot motor and arc chute is particularly simple and inexpensive, but very effective. Increased short circuit interruption capacity, and clensing arc blow out and dissipation, are provided without resorting to wide case design or otherwise resorting to industrial breaker type design.

BRIEF DESCRIPTION OF THE DRAWINGS

FIG. 2 is a view similar to FIG. 1 but showing the mechanism in a tripped position.

FIG. 4 is a sectional view taken along line 4—4 in FIG. 1 through the stationary and movable contacts of the circuit breaker.

FIG. 9 is an isometric view of an insulating cap used on the stationary contact assembly.

DETAILED DESCRIPTION

The drawings show a particular implementation of the invention in a narrow width, ¾ inch, residential or commercial circuit breaker similar to that in copending application Ser. No. 376,801, filed May 10, 1982. The two most common widths for such breakers are 1 inch and ¾ inch, which is the outside width dimension of the molded case.

Figure 1:
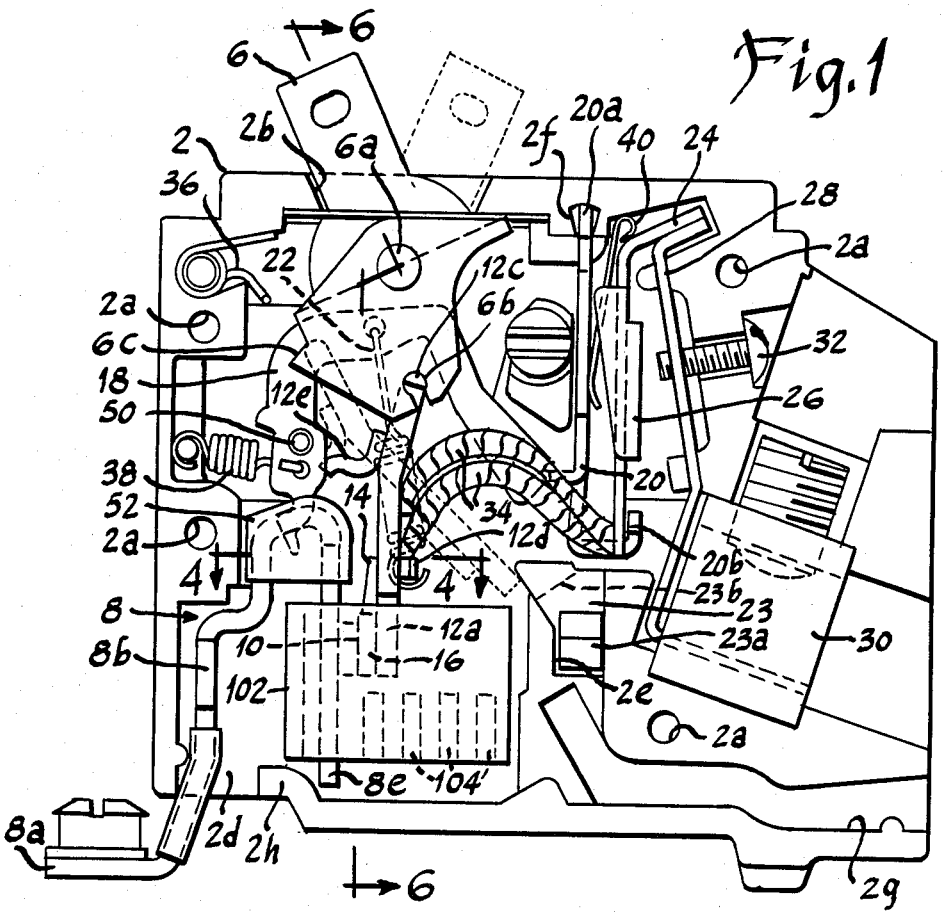
FIG. 1 is a side elevational view, with cover removed, of a narrow width residential circuit breaker having a combination slot motor and arc chute mounted therein.
Figure 5:
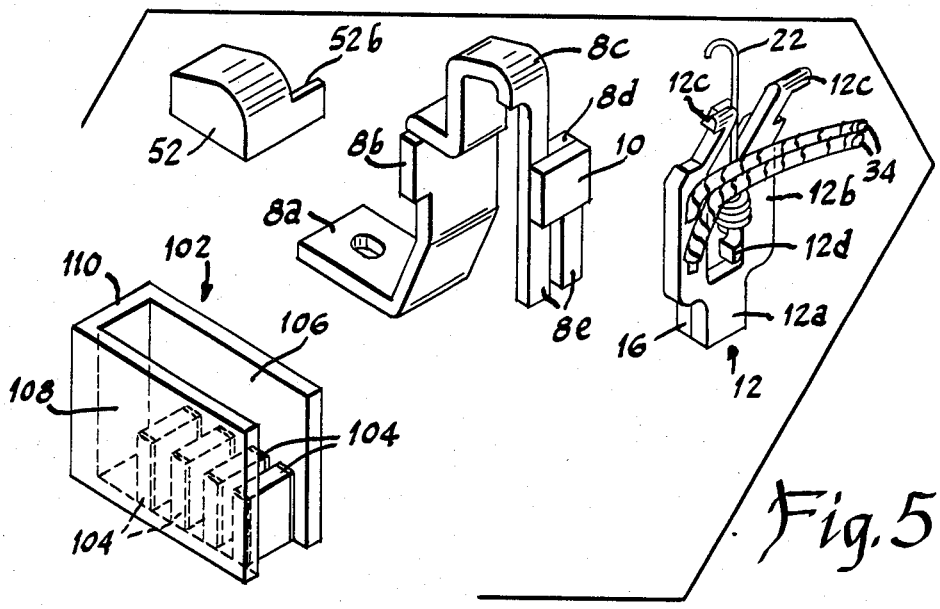
FIG. 5 is an exploded isometric view of the combination slot motor and arc chute, and contact structures of the circuit breaker of FIGS. 1 to 3.

Referring to FIGS. 1 and 5, there is shown a residential or commercial circuit breaker having a case 2 of width less than or equal to about 1 inch, and having a pair of separable contacts 10 and 16 mounted on respective current carrying conductors 8 and 12. A magnetically permeable combination slot motor and arc chute 102 is mounted within the case and around at least one of the conductors. Member 102 may be laminated or nonlaminated.

Figure 6:
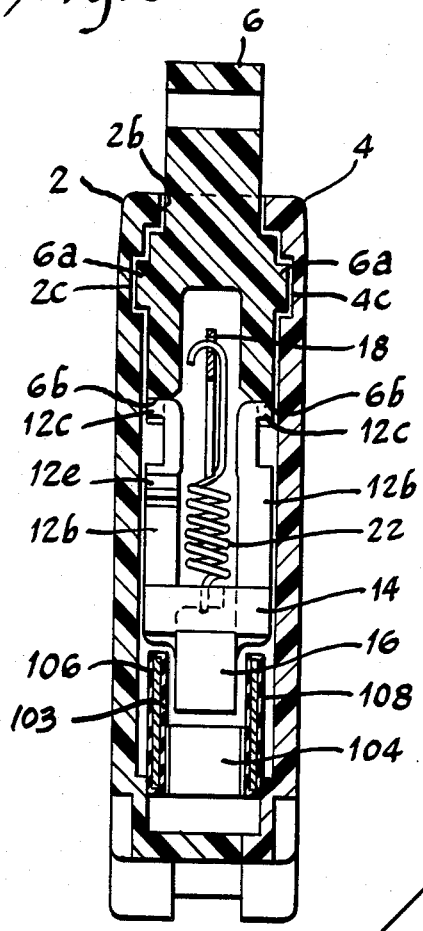
FIG. 6 is a transverse sectional view taken along line 6—6 of FIG. 1.

In preferred form, combination slot motor and arc chute 102 is around both conductors, and comprises a U-shaped magnetically permeable member coated with an arc resistant electrically insulating material 103, FIG. 6, such as epoxy, glass or the like. U-shaped member 102 receives both conductors 8 and 12 from one face side, such as the top open side, between the legs of the U. A plurality of arc plates such as 104 are on the other face side, the bottom, and extend laterally between the legs 106 and 108 of the U. The arc plates are held in place within the legs of the U-shaped slot motor such that the plates are isolated electrically from the metal of the slot motor. One such possible holding means is to fasten the arc plates to the slot motor legs by the epoxy or glass coating 103 or other bonding means on the slot motor itself. Conductor 12 is movable rightwardly toward the open end of the U away from bight 110 of the U. Conductor 8 extends adjacent bight 110 of the U. Arc plates 104 are below contacts 10 and 16. Conductor 8 includes an arc runner portion 8*e* extending generally downwardly beyond contacts 10 and 16. Arc plates 104 are spaced rightwardly of arc runner 8*e*. Arc plates 104 extend front to back across the width of the U between legs 108 and 106. Arc plates 104 extend from the bottom face side 112 of the U upwardly partially into the U, stopping short of the travel path of conductor 12 in its rightward movement toward the open end of the U. Conductors 8 and 12 extend parallel to each other in slot motor 102, and current flows through the conductors in reverse parallel opposite directions to develop magnetic repulsive force concentrated by the slot motor and urging separation of contacts 10 and 16.

Referring to FIGS. 1, 5 and 6 of the drawings, there is shown a circuit breaker having a molded insulating housing 2 which has a shallow cavity formed therein to receive the operating mechanism of the circuit breaker. A molded cover 4 is secured over the open side of the housing 2 by a plurality of rivets (not shown) which are received in openings 2*a* of housing 2 and corresponding openings in the cover 4. The forward or upper wall of housing 2 has an opening 2*b* which cooperates with a similar opening in the cover for receiving an operating handle 6 of the breaker. Operating handle 6 has a pair of trunnions 6*a* which are received in cylindrical recesses 2c and 4c in the housing and cover, respectively, to journal the handle 6 for pivotal movement.

A combination stationary contact and line-side terminal member 8 is mounted in the lower lefthand portion of the circuit breaker as viewed in FIG. 1, the terminal portion 8a projecting outwardly of the housing 2 through an opening 2d therein. The combinded contact-/member 8 is mounted in the housing 2 and cover 4 by a pair of laterally projecting tabs 8b (only one of which is visible in FIGS. 1 and 5) which are formed on the terminal portion and received in complementally formed recesses in the housing 2 and cover 4. The stationary contact portion of member 8 comprises an inverted U-shaped conductor portion 8c which has a reduced cross section with respect to the prevalent width of member 8 and is offset to one side of the member 8. The inverted U-shaped conductor portion 8c joins with a contact mounting pad 8d. A stationary contact 10 is secured to the mounting pad 8d by any suitable means such as spot welding, brazing, or the like. Projecting downwardly from the pad 8d is a bifurcated arc runner 8e which is angled forwardly in the direction of the side at which the contact 10 is secured to the member 8 to facilitate arc motion off the contact 10 as will be described hereinafter.

Figure 8:
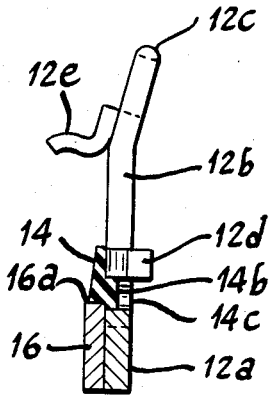
FIG. 8 is a longitudinal sectional view of the assembled movable contact assembly of FIG. 7.
Figure 7:
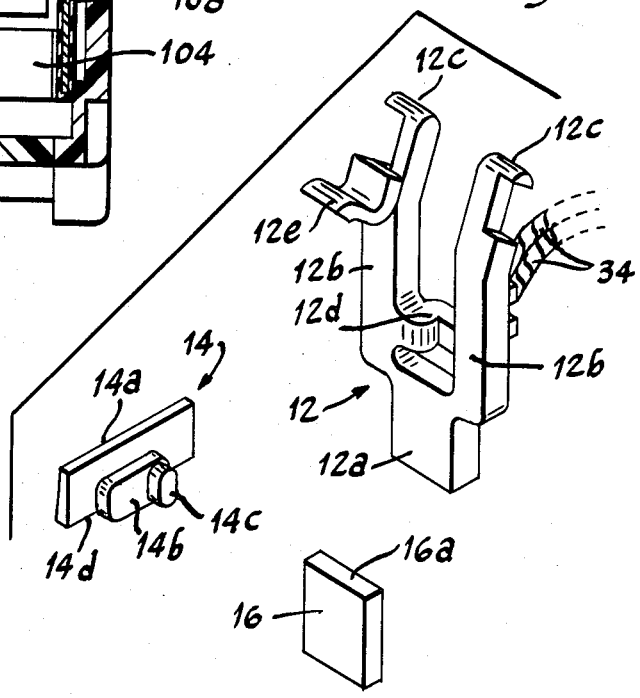
FIG. 7 is an exploded isometric view of elements comprising the movable contact assembly.

As best shown in FIGS. 5 and 7, a movable contact assembly comprises a flat Y-shaped movable contact arm 12 which has a stem portion 12a and a pair of upstanding legs 12b. The upper portions of legs 12b are formed over obliquely out of the plane of contact arm 12 and are provided at the ends with half-round, outwardly projecting ears 12c which are cooperatively received within keyhole slots 6b formed in dependent flanges of the operating handle 6 to pivotally attach movable contact arm 12 to the operating handle 6. A hook 12d extends laterally from the housing-side leg 12b in the space between the two legs and is offset to the rear, or toward the side of the contact arm 12 opposite the member 8. As may be best seen in FIGS. 7 and 8, an insulator 14 and a contact element 16 are assembled to the movable contact arm 12. Insulator 14 comprises a rectangular cross arm 14a which has a rectangular boss 14b extending from a back side thereof which in turn has an oblong boss 14c extending therefrom to the same side. The rectangular boss 14b is made to fit snugly within the opening defined by the upper portion of stem 12a, the inner sides of legs 12b and the underside of hook 12d in the base of the Y-shaped contact arm 12 to prevent movement of the insulator in the plane of the front surface of contact arm 12. The boss 14c underlies the portion of hook 12d which is offset to the rear of the contact arm 12 to further position the insulator 14 on the arm. Insulator 14 is placed to contact arm 12 such that the cross arm 14a lies flat against the flat surfaces of legs 12b with the rectangular boss 14b received in the aforementioned opening. With reference to FIG. 7, insulator 14 is assembled to contact arm 12 by rotating it ninety degrees counterclockwise in a horizontal plane and inserting the boss 14b into the aforedefined opening. As is more apparent in the longitudinal sectional view of movable contact arm 12 shown in FIG. 8, the rectangular boss 14b is offset to extend slightly below the bottom edge 14d of the cross arm 14a to present a forwardly facing surface in the same plane as the back of cross arm 14a. Contact element 16 is then secured to the stem portion 12a of movable contact arm 12 such that its upper edge 16a abuts the lower edge 14d of cross arm 14a and the upper corner of contact element 16 overlies the forward facing depending portion of rectangular boss 14b to trap insulator 14 in place on contact arm 12. Contact element 16 may be secured to arm 12 by any suitable means such as by spot welding, brazing or the like. A portion of stem 12a extends below the contact 16 and serves to draw the arc created upon contact separation away from the lower corner of the contact element 16 and direct it to the lower corner of the stem 12a of movable contact arm 12 instead. This reduces the erosion of the silver contact resulting from the arcing that occurs at contact separation.

A releasable latch lever 18 is pivotally supported at its left-hand end within a suitable formation in the housing 2. Latch lever 18 is essentially an inverted U-shaped member, the right-hand of which cooperates with a latch member 20 to restrain the latch lever 18 in the position shown in FIGS. 1 and 3. The bight portion of latch lever 18 is disposed between the depending side flanges of operating handle 6 and is provided with a hole which receives one end of a helical tension spring 22. The opposite end of spring 22 is connected to hook 12d of the movable contact arm 12 to provide an over center drive for arm 12 in a manner that is well known. Hook 12d is offset to the rear side of contact arm 12 and is covered by cross arm 14a of insulator 14 to provide protection for the lower loop of spring 22 against the arc which occurs at contact separation. Manual movement of operating handle 6 to the position shown in dotted lines in FIG. 1 carries the upper ends 12c of the movable contact arm 12 across the operating center line of spring 22 whereby the movable contact arm is driven to the dotted line position shown in the FIG. 1 against a stop 23 located in the housing 2. Return movement of the operating handle 6 to the position shown in solid lines in FIG. 1 will carry the upper ends 12c of movable contact arm 12 back over center of the line of action of spring 22 to cause the movable contact 16 to close upon the stationary contact 10.

Stop 23 is preferably a separate member which is entrapped within the housing 2 and cover 4. At one end the stop 23 is received within a three-sided recess 2e in base 2. At the other end stop 23 is provided with a two step rectangular boss 23a which is received in a complementally formed recess in cover 4. A slot 23b is formed in stop 23 to provide clearance for the lower end of latch lever 18 when the latter is released. The stop 23 is made from a thermosetting plastic material instead of being formed as an integral part of the housing 2, which is made of a glass filled polyester compound, because the thermosetting plastic material has better, impact absorbing and wear resistant properties than does the glass filled polyester material.

Figure 3:
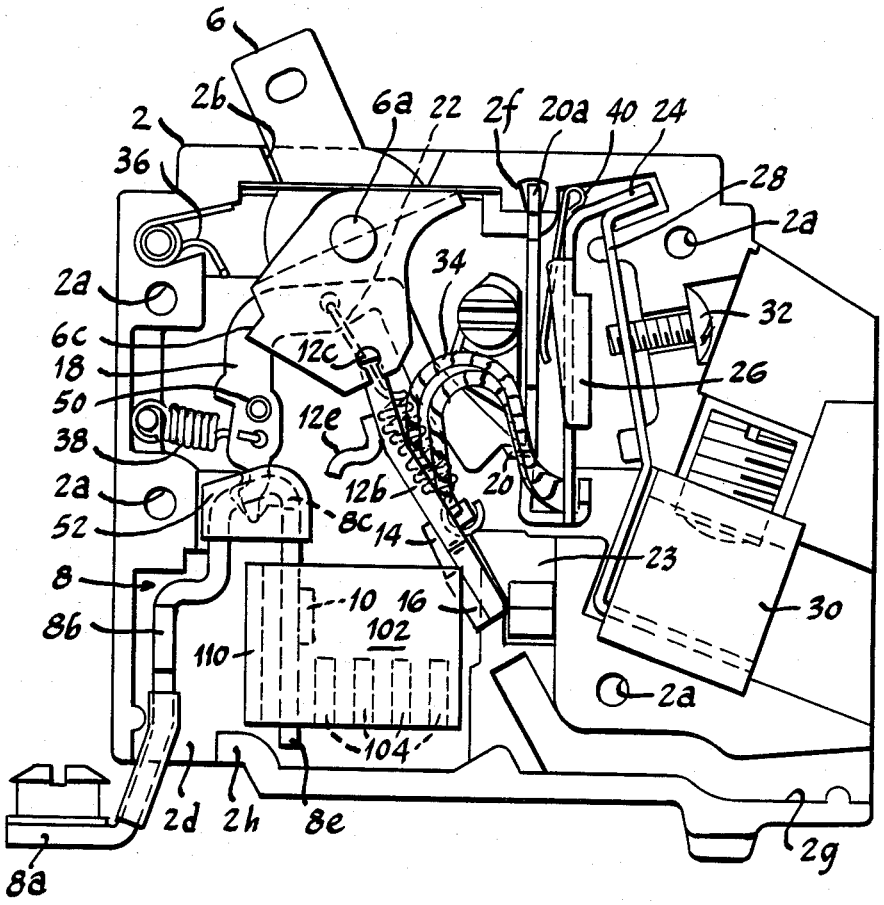
FIG. 3 is a view similar to FIGS. 1 and 2 but showing the mechanism in an open position under short circuit conditions.

The latch 20 is a part of a thermal and magnetic overcurrent trip mechanism which further comprises a bimetal member 24 around which is secured a U-shaped pole piece 26. Latch member 20 is pivotally mounted at its upper end by outwardly projecting ears 20a which are respectively received within an opening 2f in the housing 2 and a similar opening in cover 4 to serve as an armature cooperable with the pole piece 26. The lower end of the latch member 20 is offset horizontally to the left in the drawings to present a latching surface for the cradle member 18 as best seen in FIG. 3. Latch member 20 also comprises a depending hook portion 20b which extends around the opposite side of the lower end of bimetal member 24 to be engaged thereby. Bimetal member 24 is mounted within the housing by attachment at its upper end to a conductor 28 which in turn connects to a load-side pressure connector 30. A calibrating screw 32 projects through a slot in the housing 2 and threadably engages an opening in conductor 28 to adjustably position the bimetal 24 and the pole piece 26 within the housing. Bimetal member 24 also has the ends of a pair of braided flexible conductors or pigtails 34 attached to the left-hand face of its lower end such as by welding or brazing, the opposite ends of conductors 34 being connected to the cover-side leg 12*b* of movable contact arm 12 as viewed in FIG. 1.

As so far described, a circut can be seen to exist through the breaker when the mechanism is in the "on" position shown in FIG. 1 from the line side terminal 8*a* through the combination terminal and stationary contact member 8, stationary contact element 10, movable contact element 16, the cover-side leg 12*b* of movable contact 12, flexible conductors 34, bimetal 24, conductor 28 and load-side connector 30. In the event that excessive current flows through this circuit, the bimetal element 24 will become heated by the excessive current and will warp toward the right in FIG. 1 to cause its lower end to engage hook portion 24*b* and pull the latch member 20 to the right, thereby disengaging the latch portion from the latch lever 18 and releasing the latch lever to pivot clockwise about its left-hand end under the influence of spring 22. This movement of latch lever 18 carries the upper end of spring 22 over center of the upper ends 12*c* of movable contact arm 12. Once over center, the spring 22 urges the lower end of movable contact arm 12 counterclockwise, or to the right as viewed in FIG. 1, to separate contacts 10 and 16 and abut against stop 23. Spring 22 also drives the upper ends 12*c* of the movable contact arm 12 to the left as viewed in FIG. 1, thereby pivoting handle 6 clockwise until a projection 6*c* thereon engages with the end of a cushion spring 36 held in the upper left-hand corner of the housing 2. The handle then occupies a vertical "tripped" position as shown in FIG. 2 to provide indication that the breaker has tripped.

The breaker mechanism may also be tripped magnetically upon the occurrence of a larger overload current. Magnetic tripping occurs when a relatively large surge of current flows through the bimetal 24, setting up a magnetic field within the pole piece 26 to attract armature 20 to pole piece 26 and thereby moving the latch portion to the right in the same manner as had been previously described in connection with the warping of bimetal 24. Upon removal of the excess current, the breaker may be reset merely by moving the handle 6 back to the "off" position whereby the upper end of movable contact arm 12 is pivoted across the upper end of over center spring 22, thereby further shortening the operating length of spring 22 and reducing its force. A resetting tension spring 38 is connected between a cylindrical boss on the housing 2 and the left-hand, pivoted leg of latch lever 18 to exert a counterclockwise bias on the latch lever 18. As the force on spring 22 is reduced, the force exerted by spring 38 overcomes the clockwise component exerted by spring 22 to move the latch lever in the counterclockwise direction and cause the right-hand end of latch lever 18 to reengage with the latching surface of latch 20. A leaf spring 40 is retained within the housing between bimetal member 24 and latch 20 to bias latch 20 to the left whereby it will reset with the latch lever 18 as the right-hand end of the latch lever is moved into latching position.

It has been a common expedient in breaker designs to include an interaction feature between the releasable latch lever and the movable contact arm such that when the breaker trips and the latch lever is released, the latch lever movement provides some impetus to movement of the movable contact arm. This is accomplished by means of a kicker which may be a portion of the latch lever or a projection attached to the latch lever which engages the movable contact arm. A kicker is provided in the breaker by means of a roll spring pin 50 which is mounted within a hole in the left-hand leg of latch lever 18 to project transversely on opposite sides of the lever. Movable contact arm 12 has a tab 12*e* secured to the housing-side leg 12*b* thereof to project toward the roll pin 50. Tab 12*e* is provided only on one leg of movable contact arm 12 to minimize additional mass of movable contact and to provide a weld-breaking shear torque on the contacts by causing a twisting moment when pin 50 engages the the tab 12*e* as the latch lever is released by latch 20. The keyhole slots 6*b* provide a looseness in the fit of the upper ends 12*c* of the contact arm within the handle and thereby a small, but important, amount of twisting or shear torque can be applied to assist in separating the contacts should they be welded.

A pair of openings in housing 2 aid arc extinguishment. The first opening is a passageway 2*g* which extends from the right-hand arc plate 104 to the right-hand end of the housing 2. The second opening is opening 2*d* previously described as an opening through which the terminal 8*a* projected. An upwardly projecting barrier 2*h* extends from the bottom of the circuit breaker housing 2 upwardly into the opening 2*d*, this barrier having a narrow slot 2*k* formed therein. Barrier 2*h* is recessed below the plane of mating surfaces of housing 2 and cover 4 so as not to close off the opening 2*d*, but merely to prevent insertion of foreign objects such as tools, wires, or the like, in any undesired attempt to reach the contacts. Insulating cap 52 is shown from two different angles in FIGS. 5 and 9, its basic shape being closely similar to the profile of inverted U-shaped conductor portion 8*c* of terminal/stationary contact member 8. The cap 52 is hollow, having opening 52*a* (FIG. 9) to receive the portion 8*c*. A L-shaped flange 52*b* is formed on one side to overlie the wider contact pad 8*d* and to extend under a formation in housing 2 serving as the pivot of latch lever 18. Cap 52 also serves to insulate latch lever 18 and roll pin 50, which are at load-side potential, from the line-side conductor 8*c*. Insulator 14 is disposed directly opposite cap 52 when the contacts 10 and 16 are closed and the two insulating members cooperate to impede any tendency of an arc to travel upwardly along the conducting portions 8*c* and 12*b* of the stationary and movable contacts, respectively.

The combination slot motor and arc chute, and the contact structures are particularly advantageous in the interruption of short circuit currents. The stationary and movable contacts are formed to provide adjacent parallel, oppositely directed current paths which generate electromagnetic forces tending to separate the two members. Current entering the breaker through terminal 8*a* is directed downwardly in the right-hand leg of U-shaped conductor portion 8*c* to the contact mounting pad 8*d* and into stationary contact 10. That current then passes to movable contact 16, into stem 12*a* of movable contact arm 12 and upwardly within the cover-side leg 12*b* to the point at which the braided conductor 34 is attached to that leg 12*b*. As viewed in FIG. 1, the length of the parallel current paths extends from the junction of the bight of portion 8*c* with the right-hand leg to the center of the contact element 10 and from the center of contact element 16 to the point at which the braided conductor 34 is attached to leg 12*b*. By reducing the cross-sectional width of portion 8*c* and offsetting that portion to the cover side of the terminal/stationary contact member 8, the above described current path in the stationary contact member 8, is essentially aligned directly opposite the current path in the coverside leg 12*b* of the movable contact in the direction of movement of the movable contact arm 12.

The occurrence of short circuit currents flowing within the right hand leg of stationary contact member 8 and the cover-side leg of movable contact arm 12 will generate electromagnetic forces that cause the movable contact arm 12 to pivot counterclockwise about its end 12*c*, thereby separating the contacts. This action occurs much more rapidly than separation of the contacts under the tripping action of the electromagnetic trip means 20, 24, and 26. However, as the contacts separate under the electromagnetic forces of the short circuit current, the current that is let through does generate an electromagnetic tripping force which operates to attract latch 20 to pole piece 26 to release the latch lever 18 and trip the breaker mechanism open as the contact arm 12 moves toward the stop 23 under the electromagnetic forces. Accordingly, at some point in the aforementioned travel of the movable contact arm, the trip mechanism will release latch lever 18 to cause the overcenter spring 22 to drive the contact arm to rest against stop 23 and the breaker to assume the "tripped" position as shown in FIG. 2, thereby preventing reclosure of the contact 16 upon the stationary contact 10 after the short circuit current has been interrupted. The electromagnetic force continues to operate on the movable contact arm as the arm moves to the open position, thereby increasing the opening velocity of the movable contact arm. The opening velocity is enhanced by minimizing the mass of the movable contact arm 12.

Rapid extinction of the arc formed upon contact separation under high currents is necessary to reduce or hold to a minimum the let-through current carried in the arc. The fast opening velocity of the movable contact arm under short circuit conditions establishes a high rate of rise of the arc voltage which in turn reduces the let-through current. The current which is present in the arc and in the right-hand leg of the stationary contact member 8 and the arm 12*b* of the movable contact 12 establishes a magnetic force which operates to drive the arc onto the arc runner and into the arc plates 104. As the arc moves downward on the arc runner, the pressure resulting from the gas generated by the arc drives the arc gasses through the opening in the arc runner and through the vent opening 2*d*. The arc gases are similarly exhausted through right-hand vent passage 2*g* as the movable contact arm approaches stop member 23. The arc plates 104, are parallel to the arc runner 8*e* and to each other. The spacing and parallelism of the arc plates and runner take advantage of the gas generated by the arc and the resulting pressure to further aid in moving the arc into the arc plates. If the plates were positioned radially along the path of the movable contact, the space between the plates at the entry end thereof would provide a restriction to movement therethrough due to gas pressure. By mounting the plates parallel, the space between the plates is the same all through their length and no restriction to movement therethrough is created.

It is recognized that various modifications are possible within the scope of the appended claims.

We claim:

1. A residential circuit breaker having a narrow case of width less than or equal to about 1 inch, and having a pair of separable contacts mounted on respective current carrying conductors, and comprising a combination slot motor and arc chute mounted within said case and around both said conductors, wherein said combination slot motor and arc chute comprises a U-shaped member receiving both said conductors therein from one face side between the legs of the U, and having a plurality of electrically insulated arc plates on the other face side extending laterally between the legs of the U, one of said conductors being movable toward the open end of the U away from the bight of the U.

2. The invention according to claim 1 wherein said U-shaped combination slot motor and arc chute receives said conductors from above, said one conductor being movable rightwardly toward said open end of the U to separate said contacts, the other said conductor extending adjacent the bight of the U, said arc plates being below said contacts.

3. The invention according to claim 2 wherein said other conductor includes an arc runner portion extending generally downwardly beyond said contacts, said arc plates being spaced rightwardly of said arc runner.

4. The invention according to claim 3 wherein said arc plates extend front to back across the width of the U between its legs, and wherein said arc plates extend from the bottom face side of the U upwardly partially into the U stopping short of the travel path of said one conductor in its rightward movement toward the open end of the U.

5. A residential circuit breaker having a narrow case of width less than or equal to about 1 inch, and having a pair of separable contacts mounted on respective current carrying conductors, and comprising a combination slot motor and arc chute mounted within said case and around both said conductors, wherein:

said conductors extend parallel to each other in said combination slot motor and arc chute;

said case has an end wall through which an operating handle extends;

said contacts engage along a plane substantially perpendicular to said handle end wall;

said combination slot motor and arc chute has a U-shaped configuration and receives both said conductors therein from one side, one of said conductors being movable toward the open end of the U away from the bight of the U upon separation of said contacts;

said bight of said U-shaped combination slot motor and arc chute extends substantially parallel to said plane of contact engagement and substantially perpendicular to said handle end wall.

6. A residential circuit breaker having a narrow case of width less than or equal to about 1 inch, and having a pair of separable contacts mounted on respective current carrying conductors, and comprising a combination slot motor and arc chute mounted within said case and around both said conductors, wherein said combination slot motor and arc chute is a U-shaped member having a plurality of arc plates extending laterally between the legs of the U and electrically isolated therefrom and held therein by bonding means on said legs.

7. The invention according to claim 6 wherein said bonding means comprises a glass coating on said legs.

8. A residential or commercial circuit breaker comprising in combination:

an insulating enclosing case of width less than or equal to about 1 inch;

separable contacts disposed within said case;

trip means for causing separation of said contacts in response to overload currents through said contacts;

a contact arm pivoted at an upper end and having a lower free end, a first one of said separable contacts being secured to a front surface of said contact arm at said free end;

support means positioning a second one of said separable contacts in the arcuate path of travel of said first contact, said support means comprising conductive means extending from said second contact parallel to said contact arm when said contacts are engaged;

an operating mechanism for selectively causing said pivoted contact arm to move said first contact into and out of engagement with said second contact;

current flow being in opposite directions in said contact arm and said conductive means when said contacts are engaged whereby electromagnetic force generated by said current flow urges separation of said contacts; and a combination slot motor and arc chute mounted within said case and around both said contact arm free end at said first contact and said conductive means at said second contact to concentrate the electromagnetic repulsive force urging separation of said contacts, to increase the separation force, and for dissipating and extinguishing the arc between said separating contacts, wherein:

said case has an end wall through which an operating handle extends;

said contacts engage along a plane substantially perpendicular to said handle end wall;

said combination slot motor and arc chute has a U-shaped configuration and receives both said contact arm free end at said first contact and said conductive means at said second contact therein from one side, said contact arm free end at said first contact being movable toward the open end of the U away from the bight of the U upon separation of said contacts;

said bight of said U-shaped combination slot motor and arc chute extends substantially parallel to said plane of contact engagement and substantially perpendicular to said handle end wall.

9. A residential or commercial circuit breaker comprising in combination:

an insulating enclosing case of width less than or equal to about 1 inch;

separable contacts disposed within said case;

trip means for causing separation of said contacts in response to overload currents through said contacts;

a contact arm pivoted at an upper end and having a lower free end, a first one of said separable contacts being secured to a front surface of said contact arm at said free end;

support means positioning a second one of said separable contacts in the arcuate path of travel of said first contact, said support means comprising conductive means extending from said second contact parallel to said contact arm when said contacts are engaged;

an operating mechanism for selectively causing said pivoted contact arm to move said first contact into and out of engagement with said second contact;

current flow being in opposite directions in said contact arm and said conductive means when said contacts are engaged whereby said electromagnetic force generated by said current flow urges separation of said contacts; and a combination slot motor and arc chute mounted within said case and around both said contact arm free end at said first contact and said conductive means at said second contact to concentrate the electromagnetic repulsive force urging separation of said contacts, to increase the separation force, and for dissipating and extinguishing the arc between said separating contacts, wherein said combination slot motor and arc chute has a U-shaped configuration and receives both said contact arm free end and said conductive means therein from a top face side thereof between the legs of the U, and having a plurality of arc plates on the other face side extending laterally between the legs of the U, said contact arm free end being movable rightwardly toward the open end of the U away from the bight of the U, said conductive means including an arc runner portion extending downwardly beyond said second contact, said arc plates being below said contacts and spaced rightwardly of said arc runner, said arc plates extending front to back across the width of the U between its legs and extending from the bottom face side of the U upwardly partially into the U stopping short of the travel path of said contact arm free end in its rightward movement toward the open end of the U.

10. The invention according to claim 9 wherein said arc plates are electrically isolated from said legs of the U and held in place therein by electrically insulative bonding means.

11. The invention according to claim 10 wherein said bonding means comprises a glass coating.

12. The invention according to claim 9 wherein said combination slot motor and arc chute is a nonlaminated member.

13. A residential or commercial circuit breaker comprising in combination:

an insulating enclosing case of width less than or equal to about 1 inch;

separable contacts disposed within said case;

trip means for causing separation of said contacts in response to overload current through said contacts;

a contact arm pivoted at an upper end and having spaced legs extending from said pivoted upper end, said legs being joined at the free end of said contact arm, a first one of said separable contacts being secured to a front surface of said contact arm at said free end;

support means positioning a second one of said separable contacts in the arcuate path of travel of said first contact, said support means comprising conductive means extending upwardly from said second contact parallel to said contact arm when said contacts are engaged;

an operating mechanism for selectively causing said pivoted contact arm to move said first contact into and out of engagement with said second contact;

current flow being in opposite directions in said contact arm and said conductive means when said contacts are engaged whereby electromagnetic force generated by said current flow causes said contact arm to move said first contact out of engagement with said second contact independently of said trip means and said operating mechanism;

said conductive means being offset laterally with respect to said second contact to substantially align said conductive means with said one leg of said contact arm in the direction of motion of said contact arm; and a combination slot motor and arc chute mounted within said case and around both said contact arm free end at said first contact and said conductive means at said second contact to concentrate the electromagnetic repulsive force urging separation of said contacts, to increase the separation force, and for dissipating and extinguishing the arc between said separation contacts.

14. The invention according to claim 13 wherein said combination slot motor and arc chute has a U-shaped configuration and receives both said contact arm free end and said conductive means therein from a top face side thereof between the legs of the U, and having a plurality of arc plates on the other face side extending laterally between the legs of the U, said contact arm free end being movable rightwardly toward the open end of the U away from the bight of the U, said conductive means including an arc runner portion extending downwardly beyond said second contact, said arc plates being below said contacts and spaced rightwardly of said arc runner, said arc plates extending front to back across the width of the U between its legs and extending from the bottom face side of the U upwardly partially into the U stopping short of the travel path of said contact arm free end in its rightward movement toward the open end of the U.

* * * * *